US006464177B1

(12) United States Patent
Heim

(10) Patent No.: US 6,464,177 B1
(45) Date of Patent: Oct. 15, 2002

(54) SWITCH TONGUES

(75) Inventor: Armin Heim, Kreuzlingen (CH)

(73) Assignee: Schwihag Gesellschaft für Eisenbahnoberbau mbH, Tägerwilen (CH)

( * ) Notice: Subject to any disclaimer, the term of this patent is extended or adjusted under 35 U.S.C. 154(b) by 0 days.

(21) Appl. No.: 09/202,231

(22) PCT Filed: Jun. 10, 1997

(86) PCT No.: PCT/EP97/03000

§ 371 (c)(1),
(2), (4) Date: Jul. 17, 2000

(87) PCT Pub. No.: WO97/47811

PCT Pub. Date: Dec. 18, 1997

(30) Foreign Application Priority Data

Jun. 11, 1996 (DE) ..... 196 23 269

(51) Int. Cl.[7] ..... E01B 7/00

(52) U.S. Cl. ..... 246/453; 246/430

(58) Field of Search ..... 246/415 R, 430, 246/442, 452, 453

(56) References Cited

U.S. PATENT DOCUMENTS

| | | | | | |
|---|---|---|---|---|---|
| 224,157 | A | * | 2/1880 | Donkersley | 246/415 R |
| 5,622,340 | A | * | 4/1997 | Turner et al. | 246/415 R |
| 5,628,480 | A | * | 5/1997 | Vrsecky et al. | 246/453 |
| 6,189,840 | B1 | * | 2/2001 | Mantovan et al. | 246/453 |

* cited by examiner

*Primary Examiner*—S. Joseph Morano
*Assistant Examiner*—Robert J. McCarry, Jr.
(74) *Attorney, Agent, or Firm*—Sidley Austin Brown & Wood, LLP

(57) ABSTRACT

With a device for switching switch tongues the tongue tip of which lies on a roller plane of a slide chair, the switch tongue can be switched more easily when the front roller (7*a*) of a roller pair (6) is positioned lower than the rear roller (7*b*).

7 Claims, 4 Drawing Sheets

Figure 1:
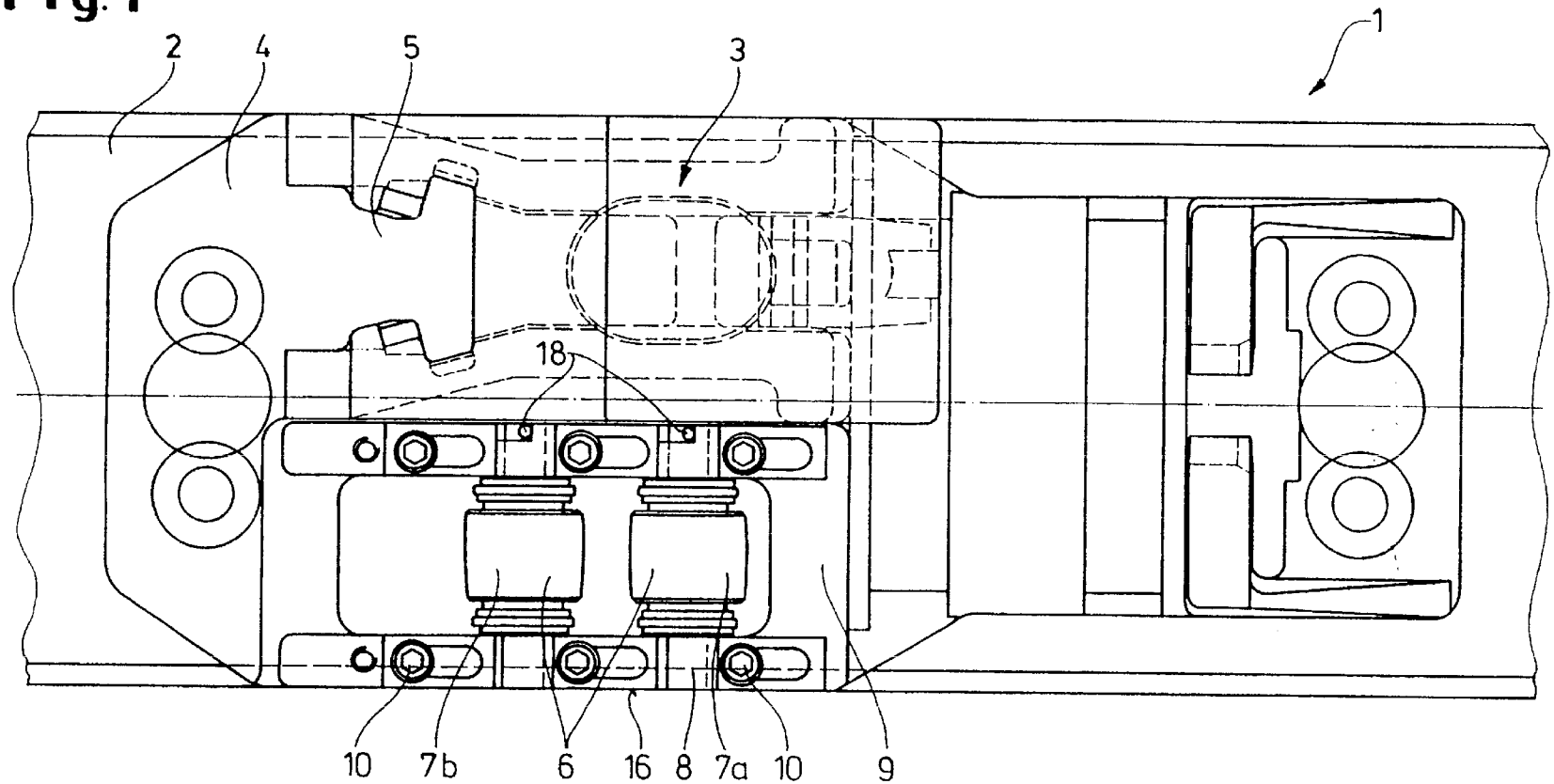

4
7a
21
17
15
16

SWITCH TONGUES

The present invention relates to a switching device for switch tongues the tongues tip of which lies on a roller plan of a slide chair.

In the known switching devices for switch tongues, the movable, i.e., horizontal pivotal regions of the switch tongues slide on slide surfaces of a slide chair. For achieving small switching forces, the slide surfaces should be greased at a certain intervals in order to obtain an operability of switching of the tongues. At high temperatures, e.g., in summer or as a result of point heating in winter, the grease resinifies often relatively very rapidly and dries up, so that the switch tongues can be switched only with a great difficulty or cannot be switched at all. If the switching device becomes inoperable, its operation should be interrupted as long as necessary for eliminating the malfunction, primarily, by greasing. During rain, e.g., the rain water often carries the grease away into a track bottom ballast which then penetrates into ground waters, which leads to pollution of the drinking water. This is non-tenable.

In order to prevent both an interruption of the operation and the ecological pollution of the ground water, it was suggested to arrange the movable regions of switch tongues on roller or ball supports and thus provide, on one hand, a rolling friction and, on the other hand, to eliminate the detrimental greasing.

In the known point-operating devices, primarily, roller supports, which have one or more rollers, are used. The roller supports are secured in a space between the cross-ties to a base of the stock rail, or are integrated into a plate of the slide chair secured to a cross-tie top. The rollers themselves can be fixedly or resiliently arranged, e.g., in an attachment frame.

The support plane of the fixedly arranged rollers, which is engaged by the bearing surface of the switching tongue heel, lies, for the most part, from about 1 to 2 mm above the slide surface of the slide chair. The correct level or elevation of the rollers is achieved, in accordance with the position of the rollers in the switching device, by insertion of sheet metal spacers. Either between the base of the stock rail and the attachment region of the roller support or between the cross-tie top and the base frame. Thereby, the rollers are arranged closed to the carrier. Despite this very laborious and relatively large time-consuming adaptation work, often other drawbacks emerge. Namely, the slide surface and the support of the base of the stock rail do not lie any more parallel to the cross-tie top, which lead to tilting of the rolling surface of the stock rail in the transverse direction.

Because of a very small clearance between the switch tongue and the slide surface of the slide chair and a small horizontal displacement of the tongue heel in the region of the switch tongue—support point, the sliding surface there cannot be lubricated. Therefore, they are provided with, e.g., a molybdenum or similar cover layer. If this covering corrodes or wears off, the slide surfaces, which are formed as separate plates, should be replaced, which is associated with high costs.

With the resiliently supported rollers, the switch tongue lies on the rollers not only during switching but also during its travel. This is a serious drawback because a smaller or larger clearance is created between the slide surface and the lifted switch tongue which may amount up to 5 mm. During the travel, because of the speed, the generated smaller or greater kinematic forces cause a corresponding impact of the tongue heel on the slide surface of the slide chair which becomes damaged as a result of plastic deformation. The plastic deformation of the bearing slide surface of the slide chair often leads to breaking of the tongue.

The object of the present invention is to provide switch device of the above-described type without the above-listed drawbacks, and with which a particularly easy tongue switching can be effected.

This object is achieved, according to the invention, by positioning the front roller of the roller pair lower than the real roller. The front roller, which is understood to be the roller on which the switch tongue runs-on first during its horizontal adjustment, is so supported that its apex is only slightly elevated above the slide surface of the slide chair. This enables an easy sliding of the tongue heel over the front roller, on one hand, and on the other hand, the horizontal force, which acts on the front roller during the run-on of the tongue heel on the front roller, is reduced by about 50% in comparison with the conventional devices when both rollers lie on the same level. Further, the front roller favorably influences a gentle sliding of the tongue heel onto the higher positioned rear roller. An easy, stepless sliding of the tongue heel on the rollers is improved by forming a chamfer in the region of the tongue base which is closest to the front roller.

According to a further embodiment of the invention, a roller is also provided in the region of the tongue heel. According to the invention, the height level of the tongue heel roller differs from those of the front roller pair. Thereby, it is possible to reduce the deflection of the switch tongue which bends vertically similar to a cubic parabola between the tongue tip and the tongue heel so that no vertical spacing is possible between the bearing surface of the tongue base and the support surface of the slide chair. The smaller deflection of the switch tongue prevents the tongue heel from engaging the slide surface in the region of the support point. Thereby fewer sliding surfaces require a cover layer in the region of the support point, on one hand, and on the other hand, the switch tongue can be switched more easily as a result of being supported with sliding friction in the region of the support point of the tongue heel.

According to an advantageous embodiment of the present invention, at least one roller is supported on an eccentric axle, and actually in each case, the front roller of the roller pair to provide for positioning of the front roller at a lower level than the rear roller in order to insure a more easy sliding onto the second, rear roller. The eccentric support with an eccentric axis provides for an easy and stepless height adjustment of the front roller and its retaining in the adjusted position.

When, advantageously, the roller associated with tongue heel has an eccentric axle support, it is possible to lift the tongue heel, if necessary, only about the fractured portion by mm, so that it does not lie on the slide surface in the support region of the tongue heel.

According to a further development of the invention, the roller axle support has a stop. The stop limits the highest and the lowest positions of the roller, while it lies on the corresponding bearing surfaces of the slide chair or the fixing frame.

In accordance with a further embodiment of the invention, the rollers are arranged in a linearly movable frame. The displacement of the fixing frame, which is integrated into the slide chair, enables, during the adjustment of the roller pair, to displace the front roller as close as possible to the tongue heel, so that a rolling movement begins, during the switching of the switch tongue, as early as possible.

Figure 2:
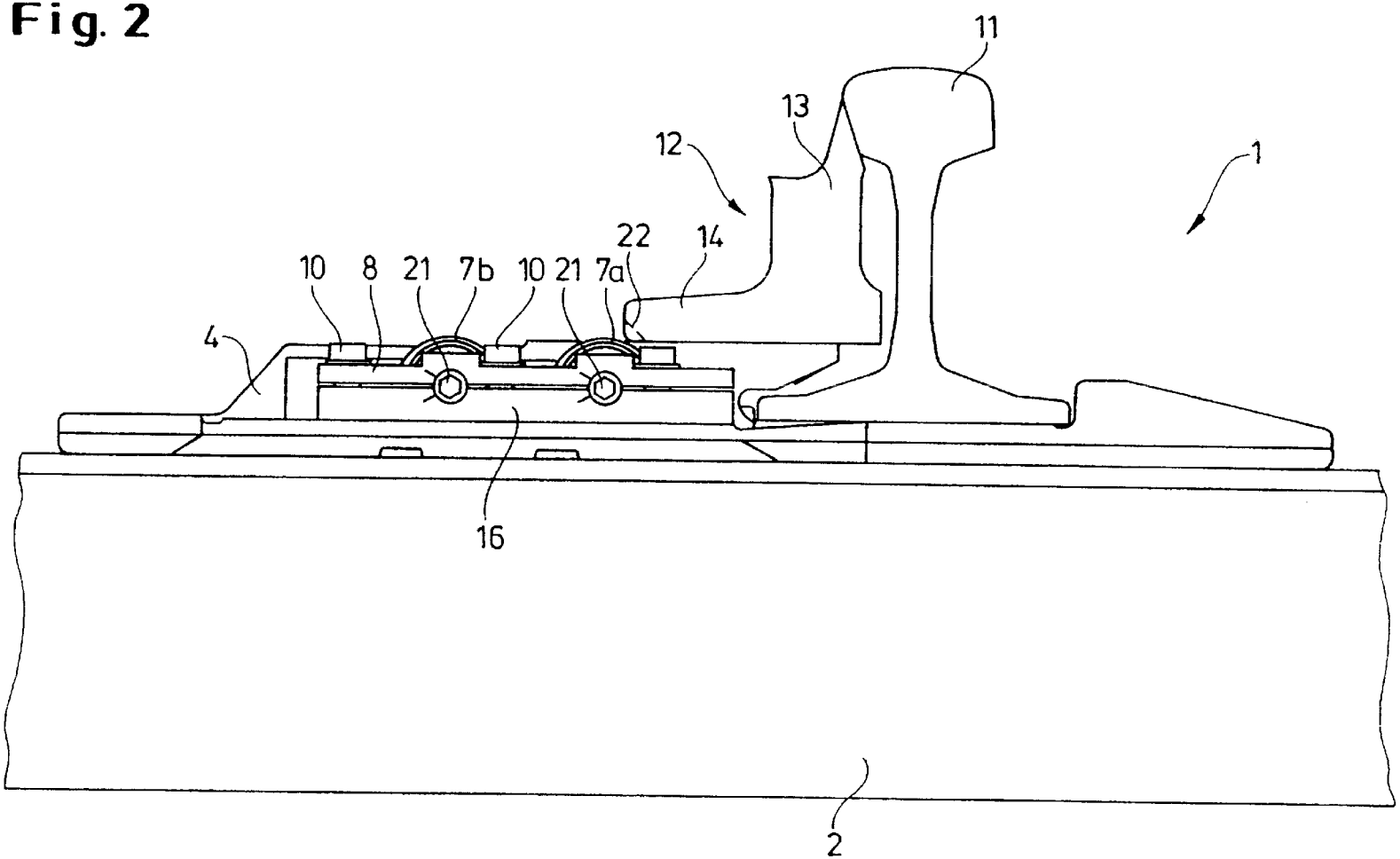
Figures 3A, 3B, 3C:
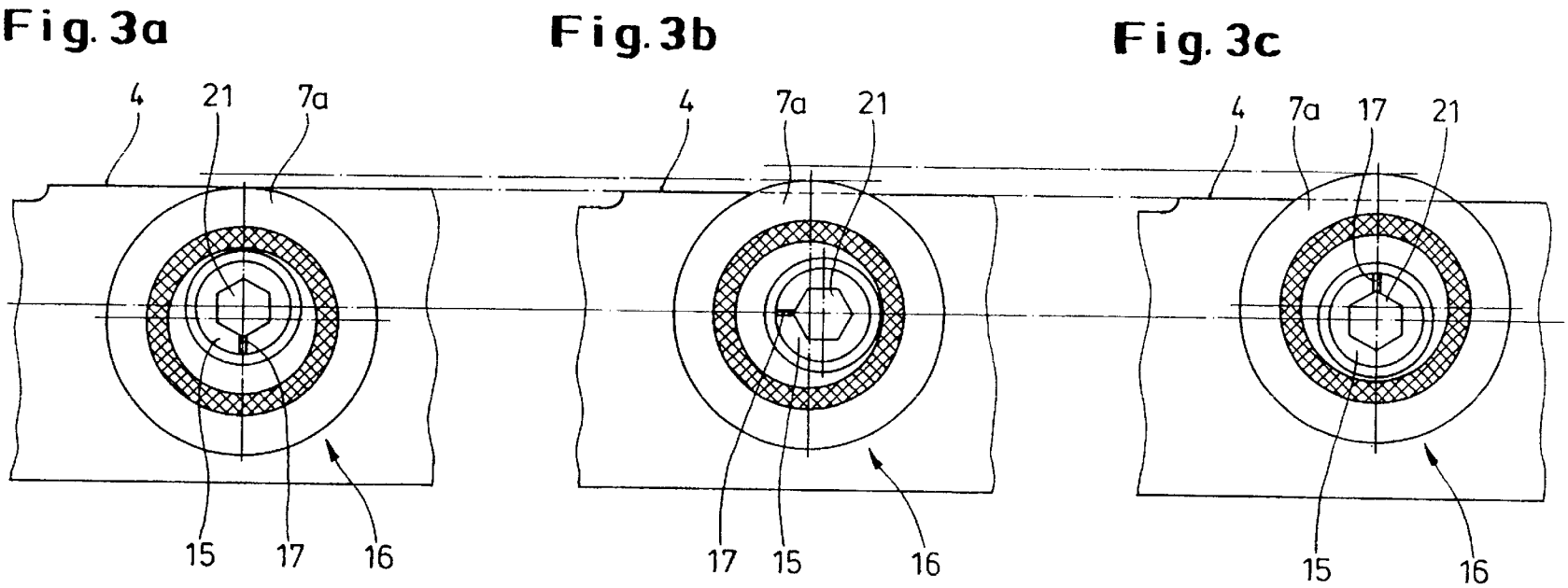
Figure 4:
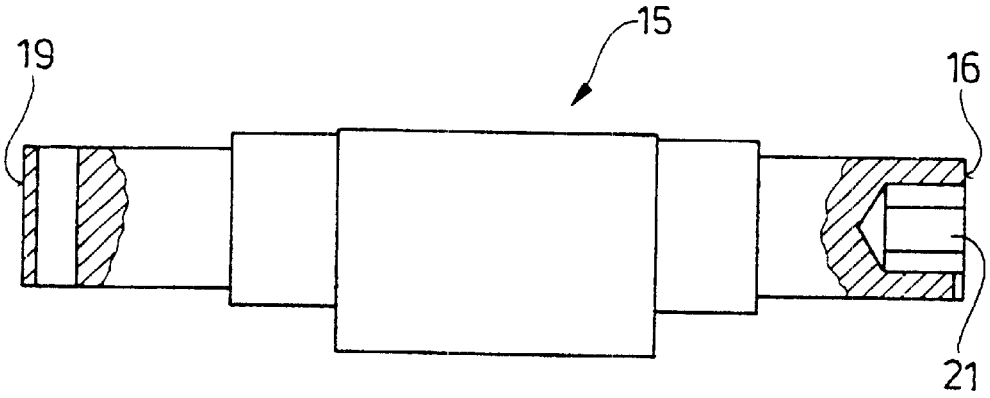

Further features and advantages of the invention will become apparent from the claims and the following description in which the exemplary embodiments, which are shown in the drawings, are discussed in detail. The drawings show:

FIG. 1 a plan view of a tightening plate of stock rails of a point with a slide chair for a switch tongue, a clamp support, and two rollers arranged in an adjustable fixing frame;

FIG. 2 a schematic side view of the tightening plate of stock rails shown in FIG. 1 with a stock rail tightened therewith and a switch tongue adjoining the stock rail;

FIG. 3*a*–3*c* a detail view of a roller arranged in the fixing frame as shown in FIG. 1 and supported by an eccentric axle in different height-adjustable positions, as seen from an adjustment side;

FIG. 4 a detail general view of the roller supporting eccentric axle; and

Figure 5:
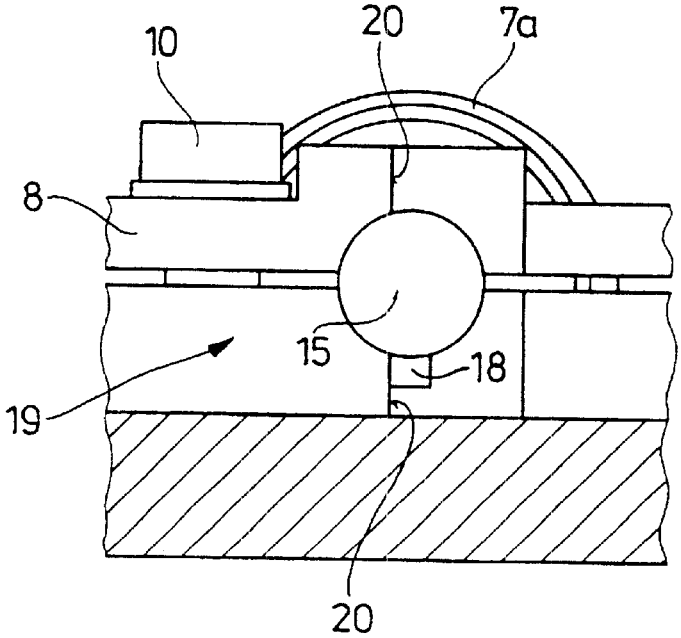

FIG. 5 a schematic detail view of a roller support of a first of front rollers, as seen from a side opposite to the adjustment side.

FIG. 1 shows a stock rail tightening plate 1 which is mounted on a point cross-tie 2 made, e.g., of wood or, as in the exemplary embodiment, of concrete. On the stock rail tightening plate 1, there are arranged, with a slide chair 3, on one hand, a stock rail tightening device 4 and a clamp support 5 and, on the other hand, a roller pair 6 including a front roller 7*a* and a rear, second roller 7*b* which are arranged in a fixing frame 8 with a possibility of adjustment of their elevation. The fixing frame 8 is linearly movable and is arranged on a slide chair plate 9. For adjusting the fixing frame 8, screws 10 should be released.

FIG. 2 shows a stock rail tightening plate 1 with a tightened stock rail 11. A tongue tip 13 of a switch tongue 12 engages the stock rail 11. A tongue heel 14 of the switch tongue 12 resets against the slide chair 3. By adjusting the fixing frame 8, the roller pair 6 is displaced, in the direction toward the tongue heel 14, to such an extent that the front roller 7*a* almost rests against the tongue heel 14, which provides for rolling movement of the tongue 12, during changing of the tongue position as early as possible. In case the roller 7*a* is adjusted by an eccentric axle 15 shown in FIG. 3 to a position which deviates from the position of rollers 7*a* and 7*b* shown in FIG. 2 and which is lower than the position of the real roller 7*b*, the tongue heel 14 can easily and almost steplessly slide over the front roller 7*a* and then gently over the higher arranged rear roller 7*b*. This effect is achieved, even if both rollers are located on the same level only then when the end of the tongue heel adjacent to the rollers 7*a* and 7*b* is provided with a chamfer 22 (FIG. 2).

Provided that a roller, which elevation is adjustable by an eccentric axle 15, is arranged in the region of a switch tongue root, which is not shown here, with the switch tongue root requiring mere one roller because of a short adjustment path, this region likewise can be slightly lifted off the sliding surface, so that here also, the rolling friction facilitate the displacement of the switch tongue.

3*a*–3*c* show the roller 7*a* in different elevational positions thereof. FIG. 3*a* shows the lowest (initial) position, FIG. 3*b* shows an intermediate position, and FIG. 3*c* shows the highest position. A position marking device 17, which is arranged on the adjustment side 16 of the eccentric axle 15, shows the illustrated positions of the roller 7*a* as well as other possible intermediate positions. The highest and lowest positions of the roller 7*a* are limited by a stop 18 (see FIGS. 1 and 5), which is provided on a side 19 of the eccentric axle 18 opposite to the adjustment side 16 and which is associated with a stop surface 20 on the fixing frame 8 (see FIG. 5). The eccentric axle 15 has, on its adjustment side 16, an internal hexagon 21 for receiving a box wrench (not shown) for rotation of the eccentric axle 15 (see FIG. 4).

The front roller 7*a* is supported on an eccentric member 15' advantageously formed as a one-piece part with the axle 15.

What is claimed is:

1. A switching device for switch tongues a tongue tip of which lies on a roller plane of a slide chair, the switching device comprising a front roller (7*a*) and a rear roller (7*e*), the front roller (7*a*) being positioned lower than the rear roller (7*c*); and an eccentric roller axle (15) provided with an eccentric member (15') for supporting at least one (7*a*) of the front and rear rollers (7*a*, 7*b*).

2. A switching device according to claim 1, wherein the eccentric member (15') is formed integrally with the eccentric roller axle (15).

3. A switching device according to claim 1, comprising a roller for supporting a switch tongue heel and an elevation of which differs from that of the roller pair (6).

4. A switching device according to claim 1, wherein the eccentric roller axle has a stop (18).

5. A switching device according to claim 1, further comprising a linearly movable frame (8) in which the front and rear rollers (7*a*, 7*b*) are arranged.

6. A switching device according to claim 5, wherein the linearly movable frame (8) forms an integral component of the slide chair.

7. A switching device according to claim 1, wherein a region of a switch tongue heel (14) adjacent to the front roller (7*a*) has a chamfer.

* * * * *